US005622469A

United States Patent [19]

Weber

[11] Patent Number: 5,622,469

[45] Date of Patent: Apr. 22, 1997

[54] BLADE FOR FORK LIFT TRUCK

[76] Inventor: Heinz Weber, 64 Gables Court, Beaconsfield, Quebec, Canada, H9W 5H4

[21] Appl. No.: 405,756

[22] Filed: Mar. 20, 1995

[51] Int. Cl.[6] ..... B66F 9/12

[52] U.S. Cl. ..... 414/785; 414/659

[58] Field of Search ..... 414/785, 659, 414/662, 663; 187/237

[56] References Cited

U.S. PATENT DOCUMENTS

| | | | |
|---|---|---|---|
| 2,432,182 | 12/1947 | Turner | 414/659 X |
| 2,468,055 | 4/1949 | Gibler | 414/659 X |
| 2,605,918 | 8/1952 | Roscoe | 414/785 X |
| 2,775,359 | 12/1956 | Carpenter | 414/785 X |
| 2,931,531 | 4/1960 | Brudi | 414/785 |
| 3,392,858 | 7/1968 | Fernstrom et al. | 414/755 X |
| 3,876,097 | 4/1975 | Svenson et al. | 414/659 |
| 4,453,874 | 6/1984 | Veldhuizen et al. | 414/659 X |
| 4,475,602 | 10/1984 | Gerstner | 414/785 X |
| 4,514,134 | 4/1985 | Frye | 414/785 X |

FOREIGN PATENT DOCUMENTS

| | | | |
|---|---|---|---|
| 2300689 | 7/1974 | Germany | 414/785 |
| 9407789 | 4/1994 | WIPO | 414/659 |

*Primary Examiner*—David A. Bucci

[57] ABSTRACT

There is provided an improved blade for a fork lift truck, the blade helping to prevent damage to pallets or other objects. The blade includes a freely rotatable member mounted at the distal end of the blade, the rotatable member being mounted to at least partially protrude beyond the distal end and the member being rotatable about an axis which is substantially normal to the longitudinal axis of the blade.

7 Claims, 2 Drawing Sheets

BLADE FOR FORK LIFT TRUCK

BACKGROUND OF THE INVENTION

The present invention relates to an improved blade for fork lift trucks and more particularly, relates to a fork lift truck blade wherein pallet protecting means are provided on the distal end on the blade.

FIELD OF THE INVENTION

The use of fork lift trucks is well known in the art and they are widely used for the loading/unloading of materials which are placed on pallets. To date, these pallets have been commonly constructed of wood. As such, the pallets are frequently damaged when struck by the blade of the fork lift truck. These occurrences are sufficiently frequent that some companies specialize only in the repair of such damaged pallets.

Wooden pallets suffer from certain disadvantages particularly where cleanliness is important. Wood is a material which absorbs liquids and cannot readily be cleansed and/or sterilized. Accordingly, in certain industries, the use of plastic pallets has started to become accepted. Although the plastic pallets are more costly at the present time, as recycling capabilities become available, it is anticipated that the use of the plastic pallets will become more widespread since they can be readily cleaned or sterilized and can be easily adapted for various uses.

Both in the case of the wood and plastic pallet, a significant portion of the damage occurs due to contact of the lift blade with the pallet. Even apart from pallet damage, damage can also occur when the blades are used directly for moving material contained in other types of containers such as barrels and the like.

There have been proposals to provide various modifications to fork lift blades. Included in such proposals are protective means for the blade in that it has been proposed that the blade or a portion thereof be enclosed with a resilient protective material. Thus, reference may be had to U.S. Pat. No. 5,221,176 which discloses the use of such a resilient material. Other patents which disclose protective materials include U.S. Pat. Nos. 2,282,201 and 2,817,792.

While the teachings of the prior art do address, to a certain extent, the problem of damage to pallets, there still exists the need for a fork lift blade which will reduce the damage caused to pallets by the distal ends of the blades when used in a normal loading/unloading environment.

SUMMARY OF THE INVENTION

It is an object of the present invention to provide for an improved blade for a fork lift truck wherein damage to a pallet will be minimized due to contact between the end of the blade and the pallet.

According to one aspect of the present invention, there is provided a blade suitable for use with a fork lift truck, the blade being a longitudinally extending member having a distal end, a freely rotatable member being mounted at the distal end of said blade, the rotatable member being mounted to at least partially protrude beyond the distal end of the blade, the member being rotatable about an axis which is substantially normal to the longitudinal axis of the blade.

In greater detail, the invention comprises the use of at least one member rotatable about an axis which is substantially normal to the longitudinal axis of the blade whereby contact between the rotatable member and another object such as a pallet will cause rotatable movement of the member and a deflecting movement to minimize damage to the pallet.

The placement of the rotatable members is such that the initial contact between the distal end of the blade and a further object will be contact between the rotatable member and the object. As such, a number of different arrangements may be utilized. For example, one may use one or a plurality of rotatable members depending upon the particular structure involved. Thus, if the blade has a somewhat tapered configuration at it's distal end, then the use of a single rotatable member may be appropriate. On the other hand, if the distal end of the blade has a somewhat blunt configuration, the use of two or more such rotatable members may be desirable. In a still further embodiment, the entire perimeter of the distal end of the blade may be protected by a rotatable member as will be discussed in greater detail hereinbelow.

The mounting of the rotatable members may conveniently be accomplished by the use of conventional shafts about which the member or members rotate. The rotatable members themselves may be made of any number of suitable materials including certain plastics, rubbers, metals, etc. Indeed, the rotatable member could, for example, have an interior of steel and have an outer covering of a somewhat resilient compressible material.

While the use of the rotatable member is ideally achieved in a normally constructed blade, it is also within the scope of the invention that one could manufacture end pieces which would be adapted to fit on the ends of already existing blades, the end pieces having the rotatable members of the present invention incorporated therein.

DETAILED DESCRIPTION OF THE DRAWINGS

Having thus generally described the invention, reference will be made to the accompanying drawings illustrating embodiments thereof, in which.

DETAILED DESCRIPTION OF THE INVENTION

Figure 1:
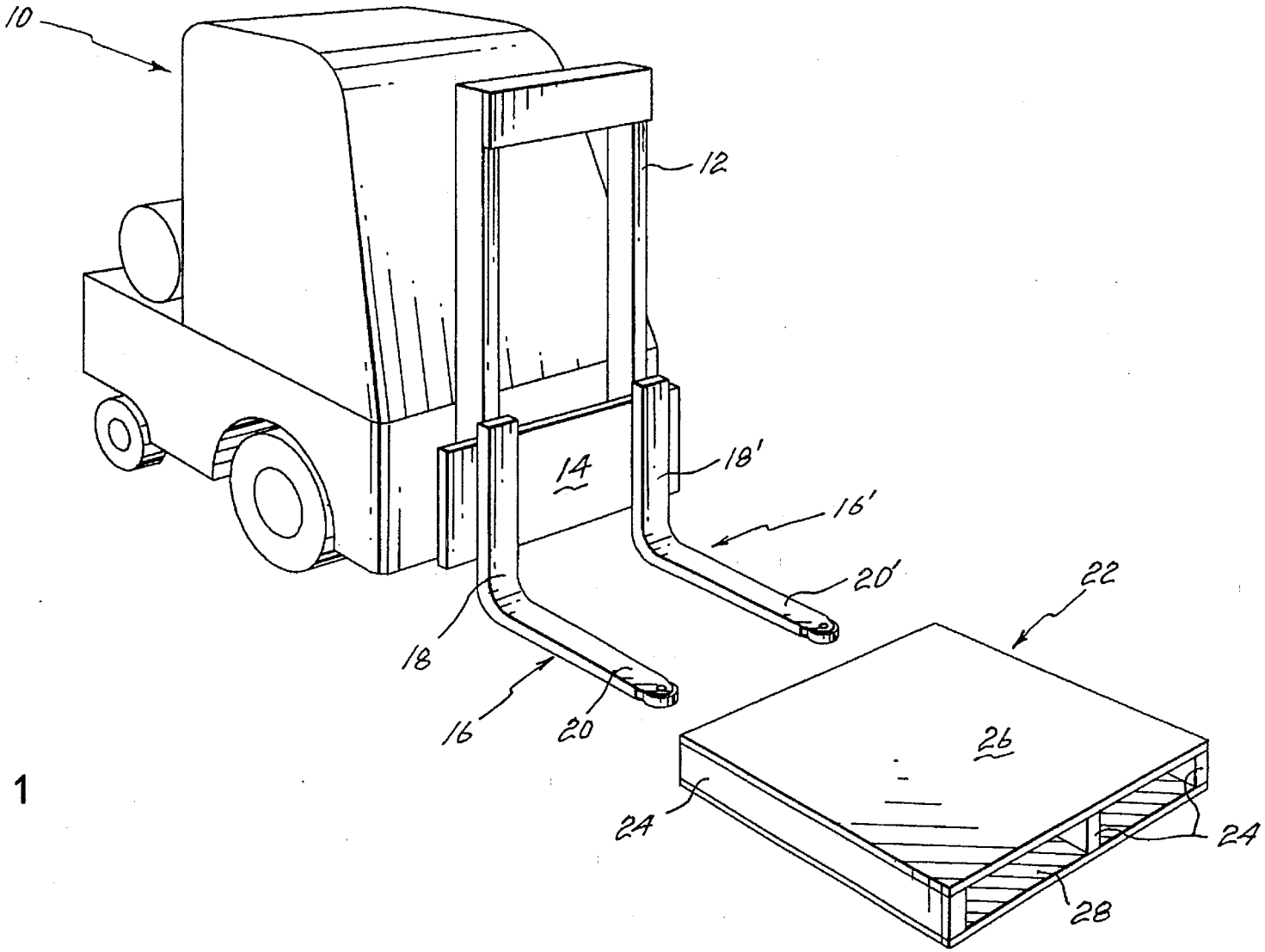
FIG. 1 is a perspective view of a fork lift truck and pallet arrangement.

In greater detail, and referring to the drawings by reference characters, there is illustrated in FIG. 1 the typical loading/unloading arrangement. Thus, there is provided a fork lift truck generally designated by reference numeral 10 and which fork lift truck has an elevating mechanism 12 to which is secured a carriage 14. Secured to carriage 14 are first and second forks 16, 16'. As is conventional, fork 16 comprises a vertical arm 18 and a horizontal blade 20.

A pallet 22 includes frame members 24 and has an upper surface 26 and a lower surface 28. As is conventional, blades 20 and 20' are adapted to fit between the upper surface 26 and lower surface 28 and in this respect, the pallet may either be a conventional wood pallet or one of the newer molded plastic pallets.

Figure 2:
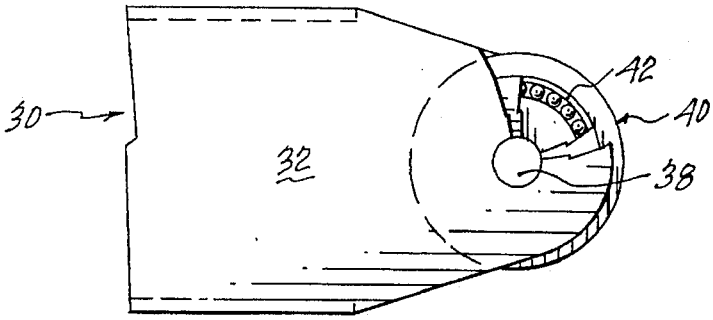
FIG. 2 is a top plan view, partially in cut away, of one embodiment of the present invention.
Figure 3:
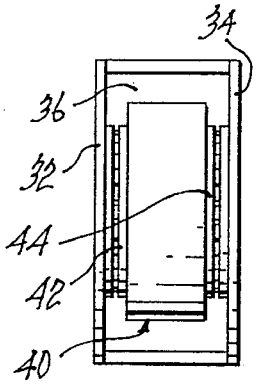
FIG. 3 is an end view thereof.

Referring to FIGS. 2 and 3, there is illustrated one embodiment of a blade which is generally designated by reference numeral 30. Blade 30 has an upper blade surface 32 and a lower blade surface 34 intermediate of which there is a recess 36. Mounted in recess 36 is a roller member 40 which is mounted on a shaft 38 which extends between upper blade surface 32 and a lower blade surface 34. Roller 40 also includes an upper bearing 42 and a lower bearing 44. Any conventional means may be provided for retaining shaft 38 in the desired position.

Figure 4:
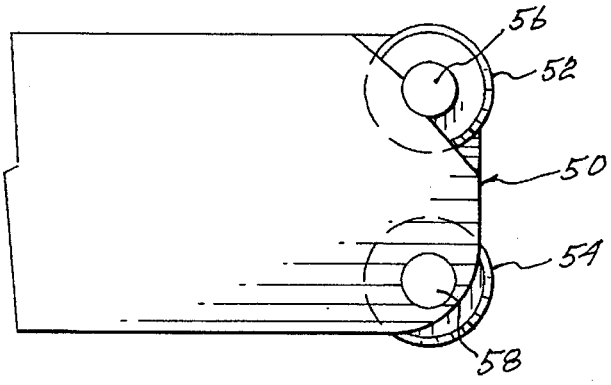
FIG. 4 is a top plan view of a further embodiment of the present invention.
Figure 5:
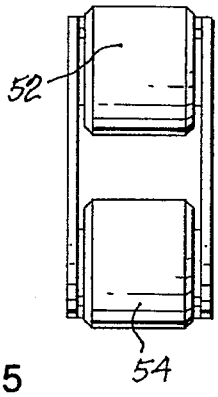
FIG. 5 is an end view thereof.

A further embodiment is shown in FIGS. 4 and 5 and will now be referred to.

In this embodiment, blade distal end 50 is of a relatively blunt configuration and has mounted at either corner thereof roller 52 and roller 54 which are mounted on shafts 56 and 58 respectively. The, structure is similar to that of the embodiment of FIGS. 2 and 3 and will include the use of suitable bearings.

Figure 6:
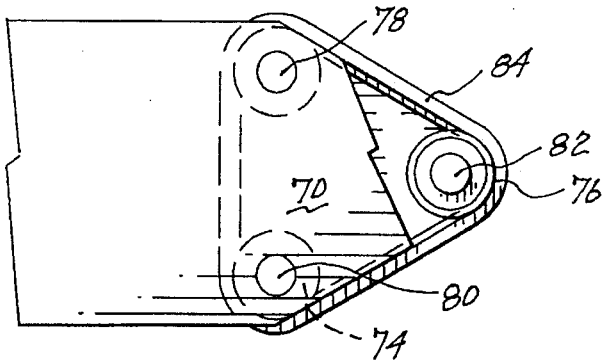
FIG. 6 is a top plan view, partially in cut away, of a third embodiment of the present invention.
Figure 7:
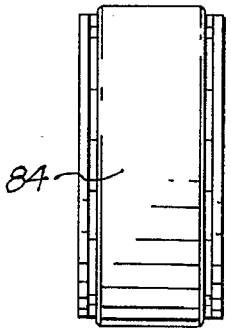
FIG. 7 is an end view thereof.

In the embodiment of FIGS. 6 and 7, at a blade distal end 70, there are provided three rollers 72, 74 and 76 mounted on shafts 78, 80 and 82 respectively. In this embodiment, a rotatable or moveable element 84 is provided and which is free to move along rollers 72, 74 and 76. Element 84 can be any suitable such as a belt type structure or the like. In operation, in all of the above embodiments, contact between the pallet and the distal end of the blade will cause a rotational movement and minimize impact damages on a pallet or other structure. Naturally, rollers 72, 74 and 76 could be eliminated and element 84 mounted directly on shafts 78, 80 and 82.

Figure 8:
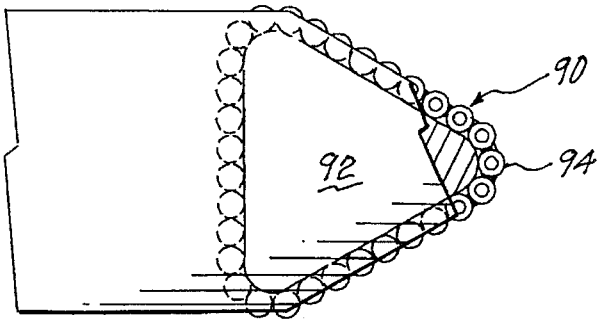
FIG. 8 is a top plan view, partially in cut away, of a still further embodiment.
Figure 9:
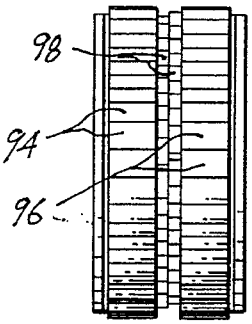
FIG. 9 is an end view thereof.

Referring to FIGS. 8 and 9, there is illustrated a further embodiment wherein a groove or channel is formed on distal end 92 of a blade. The groove or channel is provided in the side wall and a further channel extends tranversely across the blade. A member 90 is placed in the channel and functions as a rotatable member. Thus, rotatable member 90 is displaceable in the horizontal direction along the channel and has a somewhat triangular configuration in use.

Member 90, in the illustrated embodiment, comprises an upper layer of rollers 94 and a lower layer of rollers 96. Rollers 94 and 96 are connected by links 98.

In addition to the above arrangement providing a rotatable member, one may also use an initial bumper strip of a resilient compressible material to absorb an initial shock, following which contact with the rotatable member would occur.

It will be understood that the above described embodiment is for purposes of illustration only and that changes and modifications may be made thereto without departing from the spirit and scope of the invention.

I claim:

1. A blade suitable for use with a fork lift truck, the blade comprising a longitudinally horizontally extending member having a distal end, a recess formed in said distal end between upper and lower surfaces of said blade, a shaft extending between said upper and lower surfaces, and a freely rotatable member mounted on said shaft, said rotatable member being mounted to at least partially protrude beyond the distal end of said blade, said rotatable member being rotatable about a vertical axis which is substantially perpendicular to a horizontal axis of the blade.

2. The blade of claim 1 wherein said distal end has a relatively blunt configuration, said distal end having a recess formed between upper and lower surfaces of said blade, and a plurality of rotatable members mounted within said recess.

3. The blade of claim 2 including first and second rotatable members, each of said rotatable members being situated at a corner of said blade at said distal end.

4. The blade of claim 1 including a plurality of shafts extending between said upper and lower surfaces, and a rotatable member extending about said shafts and being rotatable thereabout.

5. In a fork lift truck having a pair of horizontally extending blades each having a distal end, the improvement wherein each of said blades includes a plurality of vertically extending shafts mounted on said blade adjacent said distal end, and a rotatable member entrained about said shafts and being rotatable thereabout, said rotatable member being mounted to at least partially protrude beyond said distal end of said blade.

6. The improvement of claim 5 wherein said distal ends of said blades each have a recess formed therein, said shafts being mounted within said recess between upper and lower surfaces of said blade.

7. The improvement of claim 5 wherein each of said blades has a pair of generally parallel sides, said sides tapering inwardly adjacent said distal end to thereby give a tapered portion, a recess formed within said tapered portion, said shaft being mounted in said recess between upper and lower surfaces of said blade in said recess, said shafts being located adjacent said distal end and said sides, such that said rotatable member protrudes beyond said distal end and said sides.

* * * * *